United States Patent [19]

Gates et al.

[11] Patent Number: 4,919,829

[45] Date of Patent: Apr. 24, 1990

[54] ALUMINUM HYDROXIDES AS SOLID LUBRICANTS

[75] Inventors: Richard S. Gates, Germantown; Stephen M. Hsu, Gaithersburg, both of Md.

[73] Assignee: The United States of America as represented by the Secretary of Commerce, Washington, D.C.

[21] Appl. No.: 292,176

[22] Filed: Dec. 30, 1988

[51] Int. Cl.[5] ..... C10M 173/02; C10M 103/06

[52] U.S. Cl. ..... 252/25; 252/18; 423/625

[58] Field of Search ..... 252/18, 25; 423/625

[56] References Cited

U.S. PATENT DOCUMENTS

| | | | |
|---|---|---|---|
| 4,294,687 | 10/1981 | Pinaue et al. | 228/58 |
| 4,492,682 | 1/1985 | Trebillon | 423/625 |
| 4,529,718 | 7/1985 | Dupin | 423/628 |
| 4,657,683 | 4/1987 | Davies | 252/12 |
| 4,657,754 | 4/1987 | Bauer et al. | 423/625 |

*Primary Examiner*—Jacqueline V. Howard

*Attorney, Agent, or Firm*—Thomas Zack; Alvin J. Englert; James A. Oliff

[57] ABSTRACT

Aluminum hydroxides are used as solid lubricants for aluminum oxides, ceramics and other materials having oxide surfaces. Aluminum oxide hydroxides and aluminum trihydroxides are preferred compositions for such lubricating purposes. In particular, the use of boehmite in an aqueous solution significantly reduces frictional coefficients between contacting surfaces.

21 Claims, 5 Drawing Sheets

A

B

ALUMINUM HYDROXIDES AS SOLID LUBRICANTS

BACKGROUND AND SUMMARY OF THE INVENTION

In the quest for reduced friction and wear between rubbing surfaces, several different lubrication methods have been employed. Solid lubricants are often used either alone or in conjunction with liquid lubricants to provide an easily sheared interface between sliding members. One class of compounds that exhibit solid lubricating ability is the lamellar, or layer lattice solids. These compounds contain crystal structures in which the interatomic bonding is significantly weaker in one dimension. This results in a layer structure which is easily sheared in certain directions. The best examples of these types of compounds are graphite and molybdenum disulfide ($MoS_2$). In some applications, however, the use of graphite or molybdenum disulfide is inappropriate. For instance, chemical incompatabilities between these lubricants, surfaces, and environments may limit their applications. Such as the case when graphite or molybdenum disulfide are used in oxygen containing environments at high temperatures. Also, in some applications carbon and sulfur contamination is undesirable. Further, the use of a heavy metal such as molybdenum may also be impermissible. Thus arises the necessity for a layer lattice solid lubricant which overcomes the above-mentioned drawbacks.

It is thus an object of the present invention to provide a solid lubricant to reduce frictional coefficients between contacting surfaces such as aluminum oxide surfaces.

It is a further object of the present invention to produce a solid lubricant for lubricating contacting surfaces at high temperatures.

The present invention relates to the use of aluminum hydroxides as solid lubricants for alumina, aluminum oxides, ceramics and other oxide materials. Aluminum oxide hydroxide (boehmite) and aluminum trihydroxides are preferred compositions for such lubricating purposes. In particular, the use of boehmite in an aqueous solution is disclosed as a means to reduce frictional coefficients between contacting surfaces.

BRIEF DESCRIPTION OF THE DRAWINGS

The invention will be described in detail with reference to the attached Figures, wherein.

DETAILED DESCRIPTION OF THE PREFERRED EMBODIMENTS

Figure 1:
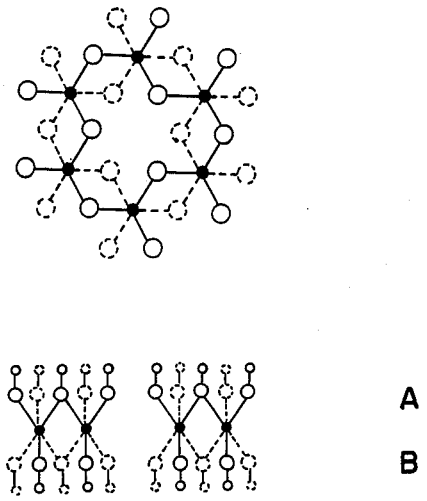
FIG. 1 illustrates the layer lattice structure of aluminum trihydroxide.
Figure 2:
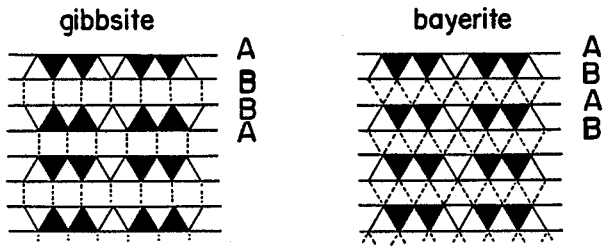
FIG. 2 illustrates the stacking sequence of two types of aluminum trihydroxide: gibbsite and bayerite.

There are two classes of aluminum hydroxides as shown in Table 1 below. Aluminum oxide hydroxide [AlO(OH)] is found in two common forms, boehmite and diaspore. Boehmite is a layer lattice compound while diaspore contains strong bonding in all three dimensions. Aluminum trihydroxide [$Al(OH)_3$] is commonly found in two forms, gibbsite and bayerite. Both of these forms are layer lattice structures, as shown in FIG. 1, which differ only in their stacking sequence as seen in FIG. 2. In FIG. 1, the solid circles represent aluminum, the small unfilled circles represent hydrogen, and the large unfilled circles represent oxygen. According to FIG. 1, darkened lines represent atomic bonds coming out of the page, dashed lines represent bonds going into the page, and regular lines represent bonds parallel to the plane of the page. Further, in FIG. 1, aluminum atoms (solid circles) are parallel to the plane of the page, atoms represented by unfilled circles are above the plane of the page, and atoms represented by dashed circles are below the plane of the page. The layer lattice hydroxides of aluminum (both aluminum oxide hydroxide-boehmite, and the aluminum trihydroxides-gibbsite and bayerite) possess solid lubricating ability. Similar results are expected for Nordstrandite, another layer lattice trihydroxide of aluminum which differs from gibbsite and bayerite only in its stacking sequence.

TABLE 1

Nomenclature for Hydroxides of Aluminum

| Chemical Name | Chemical Formula | Nomenclature System: Symposium | Nomenclature System: Alcoa |
|---|---|---|---|
| Aluminum Oxide Hydroxides or (Alumina Monohydrate) | AlO(OH) or ($Al_2O_3.H_2O$) | Boehmite | Alpha Alumina Monohydrate |
| | | Diaspore | Beta Alumina Monohydrate |
| Aluminum Trihydroxides or (Alumina Trihydrate) | $Al(OH)_3$ or ($Al_2O_3.3H_2O$) | Gibbsite or Hydrargillite | Alpha Alumina Trihydrate |
| | | Bayerite | Beta Alumina Trihydrate |
| | | Nordstrandite | |

Figure 3:
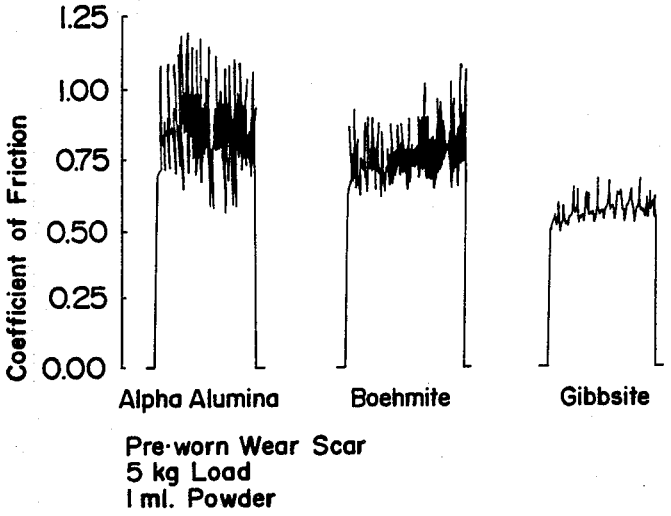
FIG. 3 illustrates friction traces for three different powder tests using a 5 kg. load on alumina balls.
Figure 4:
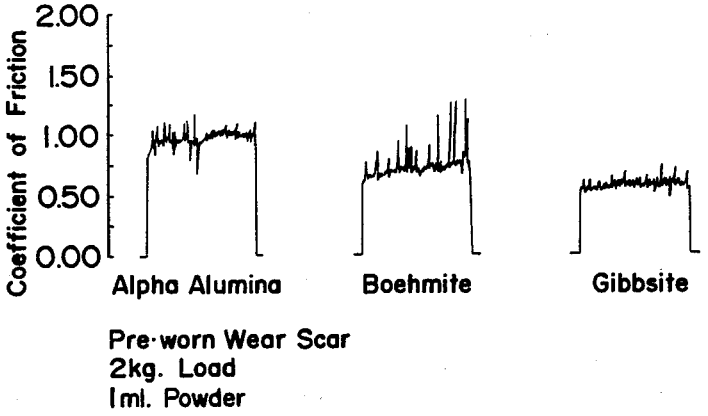
FIG. 4 illustrates friction traces for three different powder tests using a 2 kg. load on alumina balls.
Figure 5:
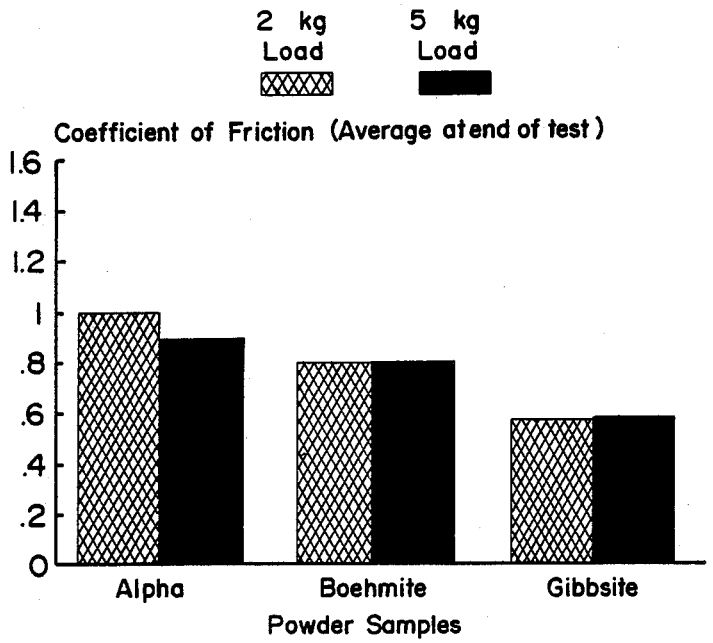
FIG. 5 is a graph comparing the final coefficient of friction values for different alumina powders at 2 kg. and 5 kg. loads.

Wear tests were conducted on a four-ball wear tester at 0.23 $ms^{-1}$ sliding speed (600 rpm), and loads considered to be in the boundary lubrication regime. Both four-ball and ball-on-three-flat wear test geometries were used. Wear test specimens were 12.67 mm (0.5 inch) diameter polycrystalline alumina balls of 99.5% purity and 97% of theoretical density. Samples of the various powders were added to both unlubricated and water lubricated alumina tests. Friction traces from the unlubricated test series are shown in FIG. 3 for a 5 kg. load and in FIG. 4 for a 2 kg. load and are summarized in FIG. 5. In these tests, boehmite provided a modest decrease in friction and gibbsite gave approximately a 40% drop in friction. A subsequent test on bayerite provided a 40% decrease in friction.

Figure 6:
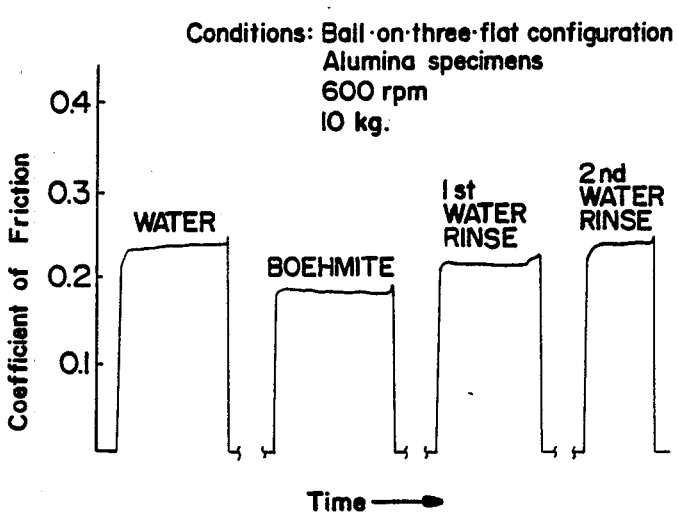
FIGS. 6 and 7 illustrate friction traces from water lubricated tests, wherein all powders were present in water at approximately 2% by weight.
Figure 7:
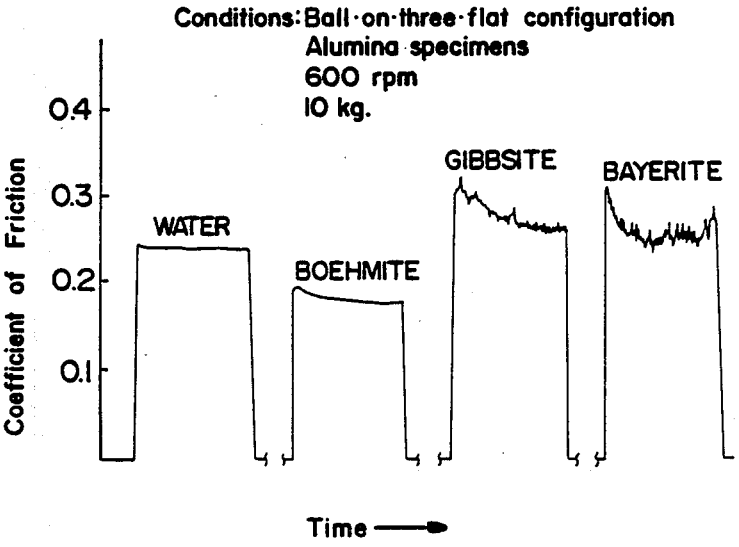

Friction traces from water lubricated tests are shown in FIGS. 6 and 7. All powders were present in water at approximately 2% by weight. Gibbsite and bayerite did not reduce friction during these tests perhaps due to an abrasive mechanism promoted by the large crystalline sizes ($>10$ $\mu m$) of the particular powders used. This theory is supported by the roughness of the friction trace. Boehmite gave a 24% reduction in friction below that of the pure water case. FIG. 7 indicates that boehmite is quite tenacious in its ability to maintain some level of lubrication even after the lubricant source (the 2% solution of boehmite) has been replaced by pure distilled water. As shown in Table 2 below, tests conducted under the conditions listed below indicate a 64% reduction in wear due to the addition of just 2% boehmite to the distilled water. Friction was reduced by approximately 24%.

TABLE 2

Wear Test Results for Boehmite (2%) in Water

| Lubricant | Wear Scar Diameter, mm | Coefficient of Friction |
|---|---|---|
| Water | 1.058 | 0.311 |
| Water + 2% boehmite | 0.380 | 0.224 |
| Difference | 0.678 | 0.087 |
| % Difference | 64% | 28% |
| Conditions: | Four-ball wear tester<br>600 rpm speed<br>10 kg load<br>10 minute duration<br>Alumina Specimens | |

Figure 8:
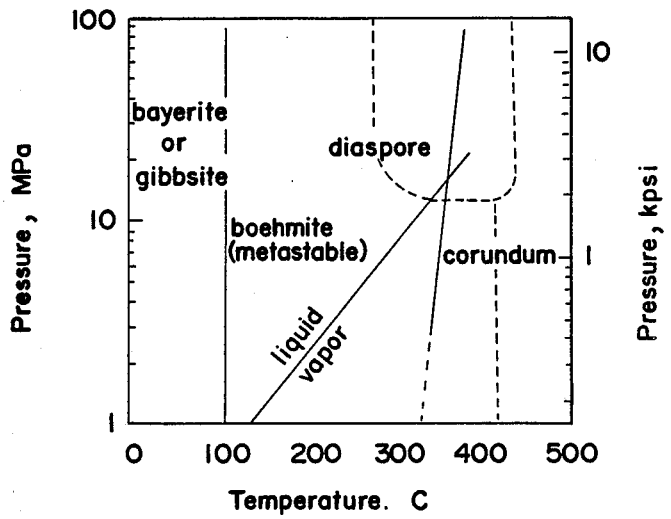
FIG. 8 is a phase diagram of an alumina-water system.
Figure 9:
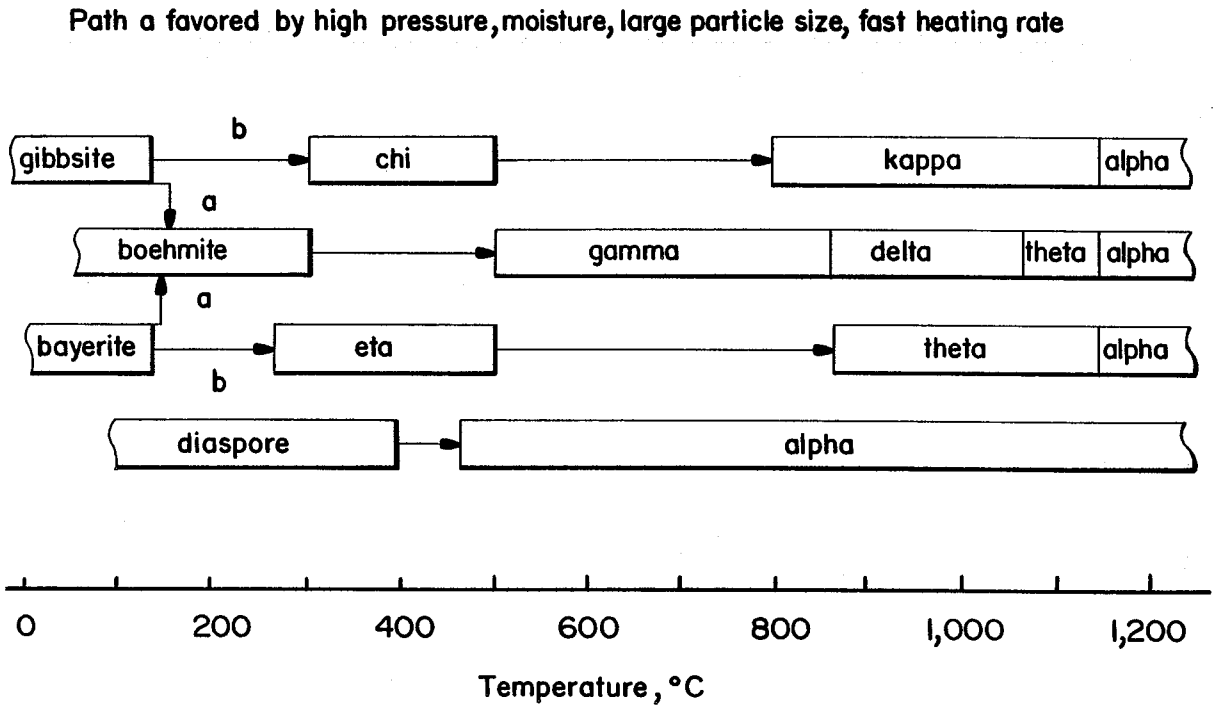
FIG. 9 illustrates decomposition sequences as a function of temperature for various aluminum hydroxides.

A phase diagram from an alumina-water system (FIG. 8) and decomposition sequences for aluminum hydroxides (FIG. 9) indicate that boehmite is the preferred high temperature, high pressure, form of aluminum hydroxide. This data also suggests an upper temperature limit on the solid lubricating ability of boehmite to be approximately 300° C. Therefore, high temperatures and severe environments may require that boehmite be used in conjunction with a cooling media. It may be possible to raise the temperature limit for these hydroxides by intercalating with appropriate compounds as has been done extensively with graphite.

Pefromance of the hydroxides as solid lubricants may be affected by such parameters as crystallite size, particle size, and purity. When used in conjunction with a liquid lubricant, performance may be affected by concentration, and variables that would affect the colloidal properties of the hydroxides (e.g. pH, the presence of ionic species).

Application for these lubricants may exist not just for alumina, but, perhaps most importantly, also for materials that form aluminum oxide layers on their surfaces (aluminum, and some aluminum containing materials). They may also function with other oxide materials and ceramics.

The present invention has been described in detail, including alternative embodiments thereof. It will be appreciated, however, that those skilled in he art, upon consideration of the present disclosure, may make modifications and improvements on this invention and still be within the scope and spirit of this invention as set forth in the following claims.

What is claimed is:

1. A lubricant for lubricating aluminum oxide layers, aluminum containing materials, ceramics and other oxide materials consisting essentially of one member selected from the group consisting of aluminum oxide hydroxides and aluminum trihydroxides dispersed in water and present in a concentration of up to about two percent by weight.

2. A lubricant according to claim 1, wherein said aluminum trihydroxide is one member selected from the group consisting of gibbsite and bayerite.

3. A lubricant according to claim 1, wherein said aluminum oxide hydroxide is boehmite.

4. A lubricant according to claim 1, wherein said member has an average crystalline size of less than 10 micrometers.

5. A lubricant according to claim 3, wherein said boehmite has an average crystalline size of less than 10 micrometers.

6. A method of lubricating an interface between an oxide material and a contacting surface which in use moves relative to said oxide material comprising applying a layer of lubricant between said oxide material and said contacting surface;

wherein said lubricant comprises one member selected from the group consisting of aluminum oxide hydroxide and aluminum trihydroxide in a particulate form.

7. A method according to claim 6, wherein said lubricant comprises an aqueous dispersion of said member.

8. A method according to claim 6, wherein said aluminum oxide hydroxide is boehmite.

9. A method according to claim 6, wherein said aluminum trihydroxide is at least one member selected from the group consisting of gibbsite, bayerite and nordstrandite.

10. A method according to claim 7, wherein said aqueous solution dispersion is about 98 percent water.

11. A method according to claim 6, wherein said powdered member has a crystalline size of less than 10 micrometers.

12. A method according to claim 7, wherein said aqueous dispersion is about 2% boehmite.

13. A method of lubricating an interface between two contacting surfaces comprising applying a layer of lubricant between said two contacting surfaces which in use move relative to each other, wherein said lubricant comprises a layer lattice aluminum compound.

14. A method according to claim 13, wherein said compound is selected from the group consisting of an aluminum oxide hydroxide and an aluminum trihydroxide.

15. A method according to claim 13, wherein at least one said contacting surface comprises at least one member selected from the group consisting of aluminum, aluminum containing materials and ceramics.

16. A method according to claim 15, wherein said lattice layer aluminum compound is selected from the group consisting of aluminum oxide hydroxides and aluminum trihydroxides.

17. A method according to claim 16, wherein said aluminum oxide hydroxide is boehmite.

18. A method according to claim 16, wherein said aluminum oxide hydroxide is dispersed in water.

19. A method according to claim 16, wherein said aluminum oxide hydroxide is boehmite and is present in a concentration of about 2 percent.

20. A method according to claim 16, wherein said aluminum trihydroxide is dispersed in water and is present in a concentration of about 2 percent.

21. A method according to claim 19, wherein said boehmite is in a powdered form and has an average crystalline size of less than 10 micrometers.

* * * * *